US005630775A

United States Patent [19]

Raasch et al.

[11] Patent Number: 5,630,775

[45] Date of Patent: May 20, 1997

[54] KICK STROKE SIMULATOR

[75] Inventors: Jason J. Raasch, Wheeling; Steve J. Fritz; David C. Barnett, both of Gurnee, all of Ill.

[73] Assignee: Dacor Corporation, Northfield, Ill.

[21] Appl. No.: 379,322

[22] Filed: Jan. 25, 1995

[51] Int. Cl.[6] ..... A63B 69/00

[52] U.S. Cl. ..... 482/83; 482/148

[58] Field of Search ..... 482/83, 148, 51, 482/55; 434/247; 73/379.01

[56] References Cited

U.S. PATENT DOCUMENTS 3,804,406 4/1974 Viscione ..... 482/83

4,819,934 4/1989 Wilson et al. ..... 482/83

*Primary Examiner*—Stephen R. Crow

*Attorney, Agent, or Firm*—Greer, Burns & Crain, Ltd.

[57] ABSTRACT

A device provides improved kick stroke simulation for the design and development of diving fins. The device includes a mechanical leg which provides the simulated kicking action and a controller for controlling the kicking action. The device is capable of controllable and reliable repetition of kicking strokes as would be used in swimming, thus allowing increased integrity of measured data related to the design of the diving fin itself. Use of the device allows for optimum design of diving fins depending on the environment in which the diving fin is to be employed. Design parameters improved include, inter alia, thrust of the diving fin and the effect on ankle fatigue of the user.

14 Claims, 3 Drawing Sheets

KICK STROKE SIMULATOR

FIELD OF THE INVENTION

The invention is generally related to simulation devices, and more particularly to swimming kick stroke simulators utilized for the development of diving fins.

BACKGROUND OF THE INVENTION

The development of efficient diving fins is a difficult challenge. The difficulty of the challenge essentially arises due to the lack of controllability/repeatability of a human's kicking stroke while swimming. Even though a human may attempt to maintain a constant speed, leg angle, cadence, intensity, etc., the fact remains that the kicking stroke will vary dramatically from one stroke to another. This being the case, it becomes difficult to make any analytical measurements of the performance and efficiency of the diving fin.

Attempts to simulate a "flipping" motion of a fin have been made. These attempts, however, have resulted in at most a device which simply flips the fin up/down in a reservoir. While this method may yield information as to how water is displaced by the fin, the integrity of the information is suspect because of the crude method utilized to move the fin in the reservoir. Additionally, this method does not provide any feedback as to how a particular fin design may effect a user's physical condition, for example ankle fatigue of the user.

Thus, a need exists for a kick stroke simulator which provides an accurate representation of a kick stroke during swimming so that the performance of the diving fin can be enhanced and the overall design of the diving fin can be optimized for particular applications.

SUMMARY OF THE INVENTION

It is therefore an object of the present invention to provide an improved kick stroke simulator for use in the design and development of diving fins.

It is therefore another object of the present invention to provide an improved means to control various parameters of the simulated kicking stroke.

It is still another object of the present invention to provide an improved means to control the speed, angle, cadence and intensity of the simulated kicking stroke.

It is another object of the present invention to provide an improved means to measure certain other parameters which result from the simulated kicking stroke.

It is still another object of the present invention to provide an improved means to measure ankle fatigue which is imported to the ankle joint by a diving fin.

These and other objects will become apparent upon reading the following detailed description of the preferred embodiment of the present invention, while referring to the attached drawings.

DETAILED DESCRIPTION OF THE PREFERRED EMBODIMENT

A device simulates a kicking stroke by implementing a mechanical leg configured to provide the kicking stroke and a means for controlling various parameters of the kicking stroke and measuring certain other parameters which result from the kicking stroke in accordance with the invention. The various parameters of the kicking stroke which are controlled include the speed, angle, cadence and intensity of the kicking stroke. The mechanical leg of the device comprises a leg portion and a foot portion which are coupled to one another via an ankle joint, the foot portion of the device being configured to accept a diving fin.

Certain other parameters result from the kicking stroke are measured. These parameters include ankle fatigue which is imported to the ankle joint by the fin when the fin and the device are immersed and operated in water, and a thrust which is generated by the fin when the fm and the device are immersed and operated in water. The device also measures an amount of work necessary to achieve a chosen thrust based on the cadence of the kicking stroke.

The kick stroke simulator in accordance with the invention allows a full analysis of the performance of various fins to provide quantitative data. For example, the device is capable of quantifying the work necessary to achieve a chosen speed or displacement, measuring the thrust generated by a set of fins and analyzing the fatigue imported to the diver's ankles when in use. The device in accordance with the invention will facilitate major breakthroughs in fin efficiency on future designs, and will also provide accurate data for comparison of all fins for design improvements.

Additionally, the proper fit of a foot pocket can be analyzed along with the smoothness of the work of the fin as required by the user, and the proper kicking form for a particular fin can be verified as well. Still other parameters of a particular fin may be analyzed visual; for example smoothness, vortices, numbers of cycles until failure, etc. Filming of fin performance can easily be made by implementing a strobe light synchronized to the fin speed. This provides clear still photographs of the fin sample under load conditions.

Figure 1:
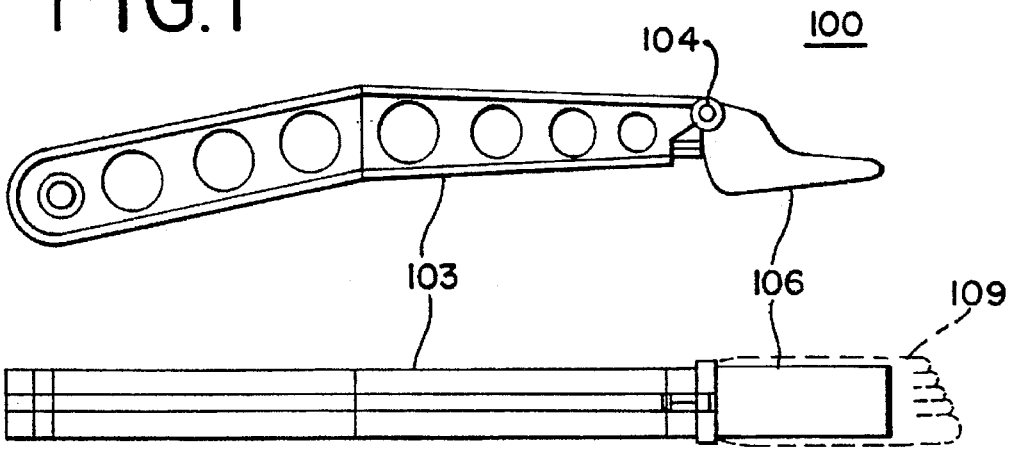
FIG. 1 generally depicts a side and top view of a mechanical leg configured to provide a kicking stroke in accordance with the invention.

A side and top view of a mechanical leg 100 configured to provide the kicking stroke is depicted in FIG. 1 in accordance with the invention. As shown in FIG. 1, the mechanical leg 100 is composed of a leg portion 103 and a foot portion 106 which are coupled to one another via an ankle joint 104. In the preferred embodiment, the leg portion 103 is constructed of aluminum, which is chosen for its light weight and durability. The leg portion 103 is approximately 46 centimeters in length, but one of ordinary skill in the art will appreciate the length of the leg portion 103 may vary.

Also depicted in FIG. 1, in dotted line form, is an outline of an anatomically correct foot 109. The anatomically correct foot 109 may be constructed of rubber, or any suitable equivalent. The anatomically correct foot 109 can be added to the foot portion 106 so as to form a proper fit for a fin during testing of the fin.

Figure 2:
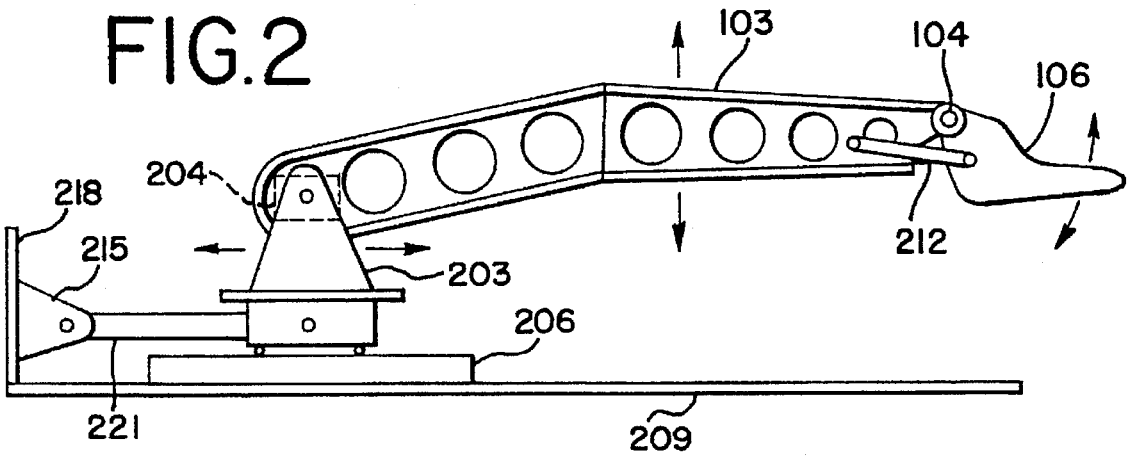
FIG. 2 generally depicts the mechanical leg mounted to a mounting platform in accordance with the invention.

The mechanical leg 100 mounted to a mounting platform 209 is depicted in FIG. 2 in accordance with the invention. As depicted in FIG. 2, the leg portion 103 is coupled to a slidable bracket 203. The slidable bracket 203 is configured with a rotary actuator 204 (shown hidden) which accepts the leg portion 103 in a press-fit manner. The rotary actuator 204 which is well known to one of ordinary skill in the art, allows the mechanical leg 100 to rotate approximately 20° in the direction given by the appropriate arrows of FIG. 2, and oscillate the mechanical leg 100 to simulate the motion exerted by a human in normal use.

While only a single mechanical leg 100 is shown in FIG. 2, one of ordinary skill in the art will appreciate that the slidable bracket 203 can be configured to accommodate a second mechanical leg likewise in a press-fit manner. In this embodiment, the second mechanical leg would be of similar construction as the mechanical leg 100. Also in this embodiment, two rotary actuators 204 would be implemented to oscillate the mechanical legs in opposite directions simulating the motion exerted by a human in normal use. The use of two mechanical legs would allow a more accurate simulation of the kicking stroke utilized during swimming so that fin design and efficiency may be optimized.

Continuing, the slidable bracket 203 is slidably mounted atop a base 206. In the preferred embodiment, the slidable bracket 203 slides on linear beatings housed within the base 206. The slidable bracket 203 is coupled to a bracket 215 via a pneumatic cylinder 221. The bracket 215 is itself rigidly anchored to an end plate 218. The pneumatic cylinder 221 acts to restrain the slidable bracket 203, and hence the mechanical leg 100, during fin testing. In the preferred embodiment, brackets 203 and 215, base 206 and end plate 218 are constructed of stainless steel, but other suitable materials may be substituted.

As depicted in FIG. 2, the foot portion 106 is restrained by a pneumatic cylinder 212. The foot portion 106 is free to rotate approximately 90° about the ankle joint 104. Movement of the foot portion 106 is utilized to simulate the action of a human foot while performing a kicking stroke during swimming.

Figure 3:
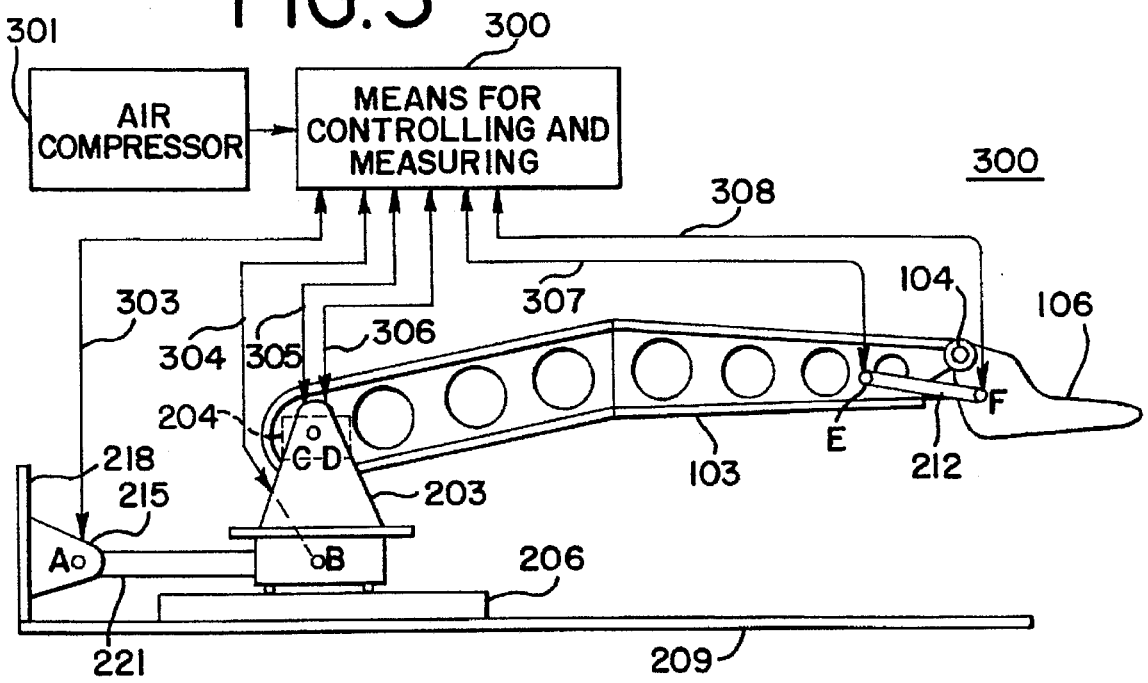
FIG. 3 generally depicts a means for controlling and measuring coupled to the mounted mechanical leg in accordance with the invention.

A means for controlling and measuring is coupled to the mounted mechanical leg 100 as shown in FIG. 3 in accordance with the invention. As shown in FIG. 3, the lines 303–308 are air lines which are utilized to drive and monitor the pneumatic 14 cylinders 212 and 221 and the rotary actuator 204 utilized to torque the mechanical leg 100. The lines 303–308 are coupled to the means for controlling and measuring 300 via a manifold (not shown) and to the mounted mechanical leg 100 at points A–F respectively. In other words, each side of the pneumatic cylinders 212 and 221 and the rotary actuator 204 are controlled and monitored in accordance with the invention. The means for controlling and measuring 300 also has coupled thereto an air compressor 301 which supplies the air required to drive the rotary actuator 204.

Figure 4:
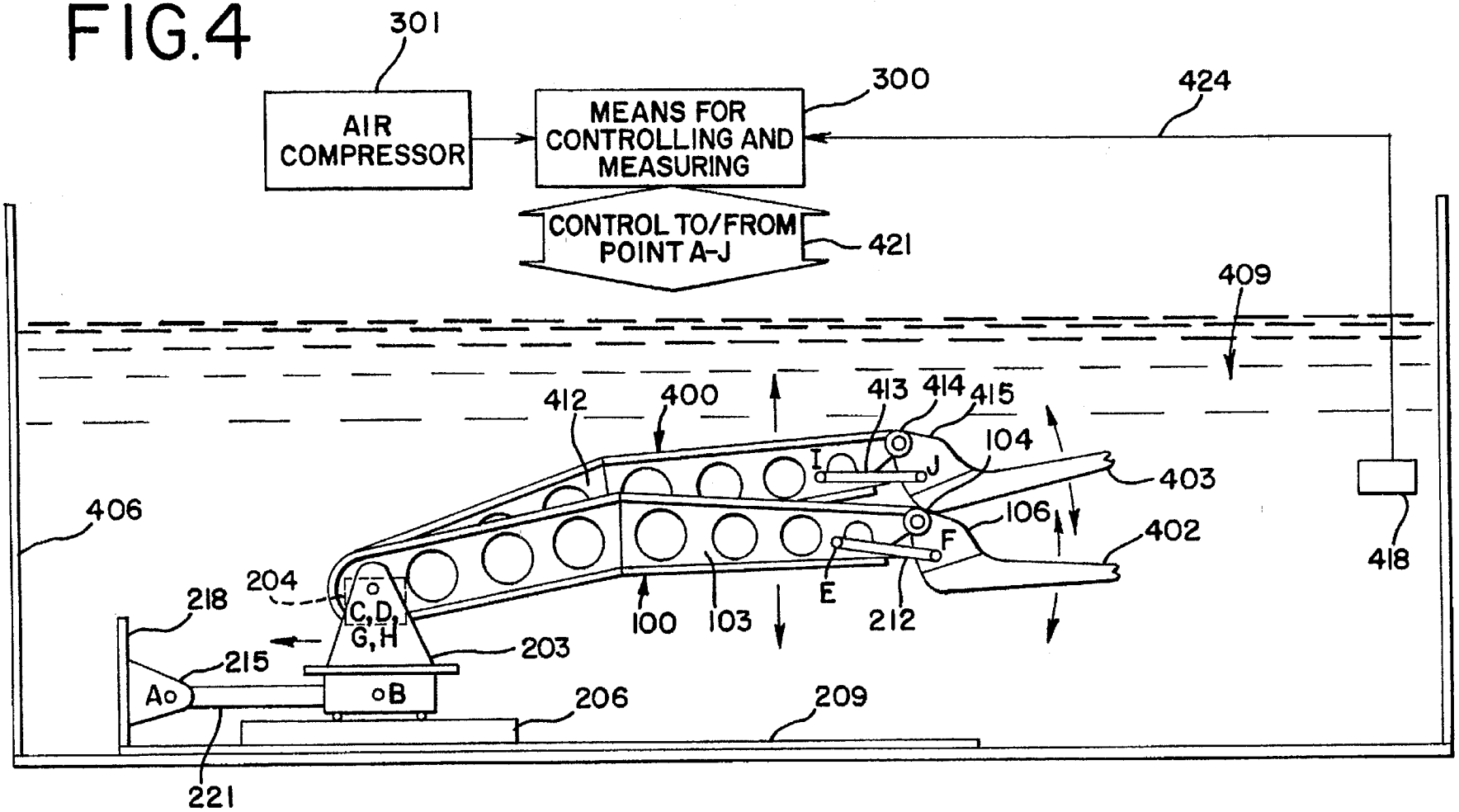
FIG. 4 generally depicts two mechanical legs submerged in water and in operation for fin testing in accordance with the invention.

Two mechanical legs submerged in water and in operation for fin testing are depicted in FIG. 4 in accordance with the invention. As previously stated, use of two mechanical legs would allow a more accurate simulation of the kicking stroke utilized during swimming so that fin design and efficiency may be optimized. As such, two mechanical legs for kick stroke simulation in accordance with the invention are explained.

As shown in FIG. 4, two fins 402, 403 are attached to foot portions 106, 415 respectively. The means for controlling and measuring 300 is coupled to the points A–J in FIG. 4, as substantially depicted in FIG. 3, by the lines 421. During operation, the means for controlling and measuring 300 controls the two rotary actuators so as to torque the mechanical legs 100, 400 (with fins 402, 403 attached to foot portions 106, 415) at a designated cadence up and down (but out of phase with one another) as shown by the appropriate arrows in FIG. 4. In the preferred embodiment, the means for controlling and measuring can be any microprocessor based controller suitably programmed to control the motion of the mechanical legs 100, 400.

The mechanical legs 100, 400 torqued up and down at the designated cadence simulates the kicking stroke. By simulating the kicking stroke, water 409 is displaced which results in a thrust (toward the end plate 218) exerted upon the slidable bracket 203. The thrust exerted on the slidable bracket 203 is transferred to the pneumatic cylinder 221. Consequently, by measuring the amount of pressure at the points A and B of pneumatic cylinder 221, a thrust measurement can be made. With this information, the amount of work necessary to achieve a chosen thrust can be measured based on the cadence of the kicking stroke.

While the mechanical legs 100, 400 are torqued up and down at the designated cadence, the fins 402, 403 likewise move up and down as shown by the appropriate arrows in FIG. 4. The motion of the fins 402, 403 in the up and down direction is transferred to the pneumatic cylinders 212, 413 respectively. In a fashion similar to that described above in relation to the pneumatic cylinder 221, the pressure at the points E–F (mechanical leg 100) and the points I–J (mechanical leg 400) can be measured. These measurements can be translated into, inter alia, ankle fatigue which is imported to the ankle joints 104, 41,1 by each of the fins 402, 403.

In the preferred embodiment, the mounted mechanical legs 100, 400 are submerged in water 409 contained by a tank 406. The tank is elliptical in shape to facilitate a flow of water 409 around the outer edge of the tank 406. The flow and speed of water 409 displaced by the fins 402, 403 during operation can be measured by a flow measurement device 418, which is well known in the art. The output of the flow measurement device 418 is a signal 424 which can be input into the means for controlling and measuring 300 to facilitate and refine measurements taken by the device in accordance with the invention.

Figure 5:
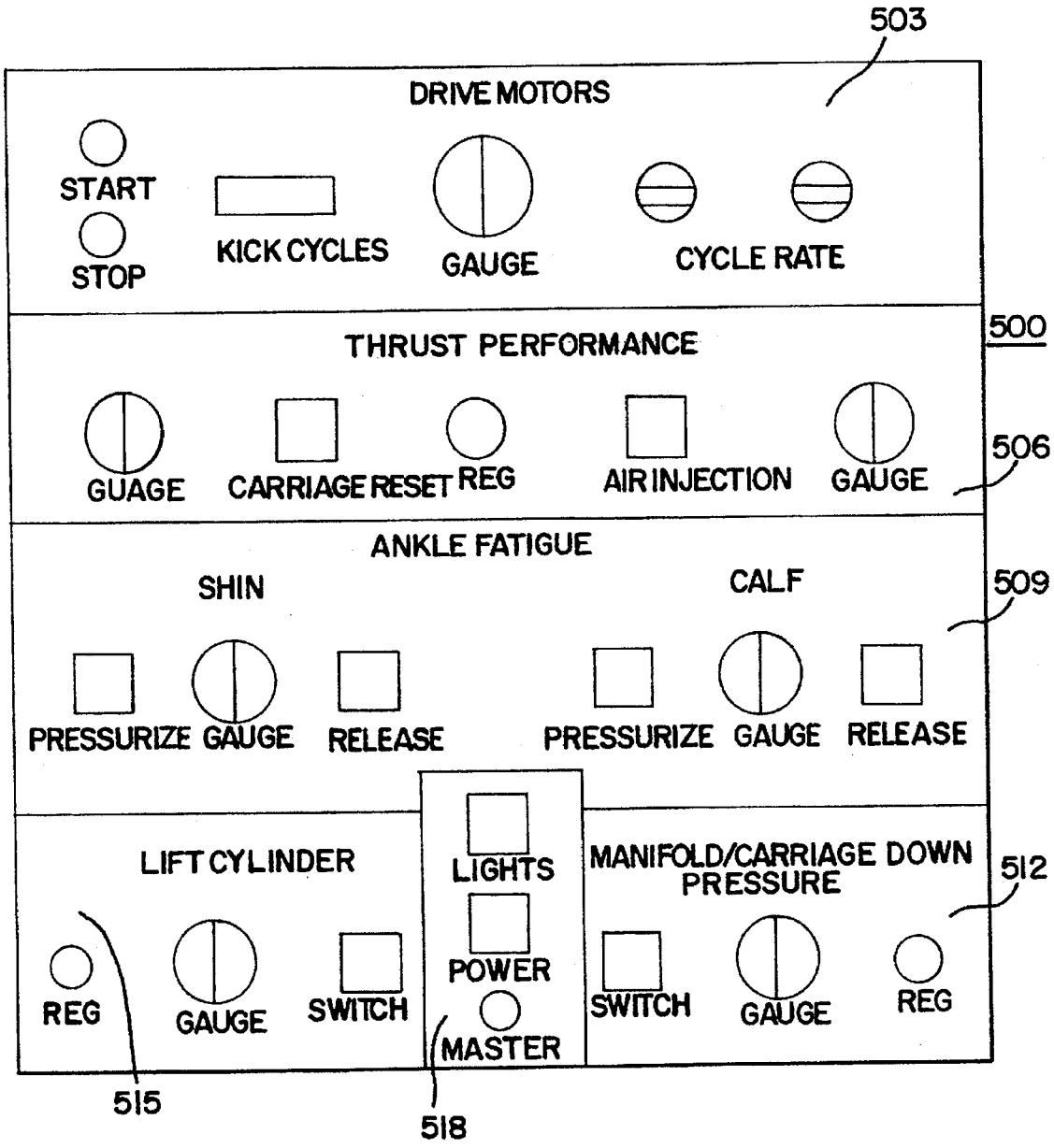
FIG. 5 generally depicts the control panel of the device which is coupled to the means for controlling and measuring in accordance with the invention.

A control panel 500 of the means for controlling and measuring 300 in accordance with the invention is depicted in FIG. 5. As shown in FIG. 5, the control panel 500 displays measured and monitored parameters such as the status of drive motors (rotary actuators 204) 503, thrust performance 506, ankle fatigue 509, lift cylinder status 515 (related to a lifting of the mechanical leg 100), manifold/carriage down pressure status 512 (related to a dropping of the mechanical leg 100), and general instruments 518. The control panel 500 houses the regulators, solenoids, gauges, switches, etc. which are coupled to the lines 303–308 which connect to points A–F in FIG. 3 (or points A–J of FIG. 4). A manifold structure (not shown) is implemented to organize the lines 303–308 as shown in FIG. 3 or the lines 421 as shown in FIG. 4.

While various embodiments of the present inventions have been shown and described, it should be understood that various alternatives, substitutions and equivalents can be used. Various features of the present invention are set forth in the following claims.

We claim:

1. A kick stroke simulator machine for simulating the action of a swimmer's kicking legs, comprising:

at least one mechanical leg with a foot end and an end opposite said foot end;

a foot portion pivotably connected to said foot end;

actuator means connected to said opposite end for oscillating said leg in a vertical plane;

a fixed base; and sliding means for sliding said actuator means relative to said fixed base so that upon connection of a swimming fin to said foot portion, and the immersion of said machine in a liquid, the oscillation of said leg by said actuator means causes said foot to create a propulsion which slides said leg toward said base.

2. The machine as defined in claim 1 further including biasing means for providing a biasing force against said propulsion action of said leg.

3. The machine as defined in claim 2 wherein said biasing means includes a fluid pressure cylinder having a first end connected to said sliding means and a second end connected to said base.

4. The machine as defined in claim 3 further including measuring means connected to said cylinder for measuring the force of said propulsion.

5. The machine as defined in claim 1 further including a pair of said legs, each said leg connected to a separate actuator means, said actuator means being configured to oscillate said legs in opposite cadences to simulate the kicking action of a swimmer.

6. The machine as defined in claim 1 further including a foot fluid powered cylinder connected at one end to said foot portion and at said opposite end to said leg for measuring the force generated by the action of said foot.

7. The machine as defined in claim 6 further including control means connected to said fluid power cylinder, to said actuator means, and to said foot fluid power cylinder for controlling the operation of said at least one leg.

8. A kick stroke simulator machine for simulating the action of a swimmer's kicking legs, comprising:

a pair of mechanical legs, each provided with a foot end and an end opposite said foot end;

a foot portion pivotably connected to said foot end of each said leg by an ankle joint;

actuator means connected to said opposite end of each said leg for oscillating said corresponding leg in a vertical plane, said actuator means constructed and arranged so that said legs oscillate in opposite cadences to simulate the kicking action of a swimmer;

a fixed base; and sliding means for sliding said actuator means relative to said fixed base so that upon connection of a swimming fin to each said foot portion, and the immersion of said machine in water, the oscillation of said legs by said actuator means causes said foot portions to create a propulsion which slides said legs toward said base.

9. The machine as defined in claim 8 further including a foot fluid powered cylinder connected at one end to said foot portion and at said opposite end to said leg for measuring the force generated by the action of said foot.

10. The machine as defined in claim 9 further including control means connected to said fluid power cylinder, to said actuator means, and to said foot fluid power cylinder for controlling the operation of said at least one leg.

11. A kick stroke simulator machine for simulating the action of a swimmer's kicking legs, comprising:

at least one mechanical leg with a foot end and an end opposite said foot end;

a foot portion pivotably connected to said foot end;

actuator means connected to said opposite end for rotating said at least one leg in a vertical plane; and a tank configured for retaining liquid in which said at least one leg, said foot portion and said actuator means are immersible for simulating the underwater kicking action of a swimmer.

12. The machine as defined in claim 11 further including a pair of said mechanical legs, each with a corresponding said foot portion, and each connected to a respective actuator means so that the legs are vertically oscillated in opposite cadences to simulate kicking action.

13. The machine as defined in claim 11 further including controlled biasing means for providing a resistance to propulsion created by said kicking action.

14. The machine as defined in claim 13 further including measuring means for measuring said biasing force.

* * * * *